United States Patent [19]

Johnson

[11] 3,947,390

[45] Mar. 30, 1976

[54] ARCH SHAPED SNAP-TYPE SWITCH CONTACT

[75] Inventor: Wendell C. Johnson, Topanga, Calif.

[73] Assignee: Xerox Corporation, Stamford, Conn.

[22] Filed: Sept. 23, 1974

[21] Appl. No.: 508,485

[52] U.S. Cl. ..... 200/5 R; 200/5 A; 200/67 DB; 200/159 B; 200/275; 200/DIG. 1

[51] Int. Cl.[2] ..... H01H 13/26; H01H 1/06

[58] Field of Search ..... 200/5 R, 5 A, 83 B, 83 N, 200/86 R, 159 B, 275, DIG. 1, 67 D, 67 DA, 67 DB

[56] References Cited

UNITED STATES PATENTS

| | | | |
|---|---|---|---|
| 3,600,528 | 8/1971 | Leposavic | 200/5 A |
| 3,643,041 | 2/1972 | Jackson | 200/5 A |
| 3,684,842 | 8/1972 | Boulanger | 200/5 A UX |
| 3,742,157 | 6/1973 | Leposavic | 200/159 B X |
| 3,751,612 | 8/1973 | Hansen | 200/275 X |
| 3,777,082 | 12/1973 | Hatley et al. | 200/5 A |
| 3,800,104 | 3/1974 | Lien et al. | 200/5 A |
| 3,860,771 | 1/1975 | Lynn et al. | 200/5 R X |
| 3,898,421 | 8/1975 | Suzumura | 200/241 X |

*Primary Examiner*—James R. Scott
*Attorney, Agent, or Firm*—J. E. Beck; T. J. Anderson; Leonard Zalman

[57] ABSTRACT

A switching plate having a plurality of arch-shaped snap-type switching members formed in a continuous metallic sheet or from sections of a metallic sheet bonded to an insulating substrate. Adjacent of the switching members extend in transverse directions. The switching members will snap downward when forced sufficiently downward thereby achieving contact or capacitive switching.

The switching members are formed in a metallic sheet by providing a first plurality of groups of parallel slots in one direction and a second plurality of groups of parallel slots in a transverse direction, one of the slots of the first group being longer than the other slots. The sheet is placed in a die having members conforming in shape to the desired arches, wherein the sheet is deformed elastically at desired locations to provide the arch-shaped snap-type switching members.

13 Claims, 9 Drawing Figures

ARCH SHAPED SNAP-TYPE SWITCH CONTACT

BACKGROUND OF THE INVENTION

In U.S. Pat. No. 3,643,041, there is disclosed a switchplate formed on a continuous flat metal sheet having a plurality of dome-shaped resilient deformable dimples therein. The dimples are convex upward. Downward pressure, such as applied through a key device by an operator's finger, is resisted until a certain predetermined force is exerted, whereupon the dimple "collapses" with a "snap" action, resulting in the convex portion of the dimple becoming concave and the dimple contacting a fixed contact button located therebeneath.

In an example of the dimensions of the dimples, the patent teaches that the dimples may be approximately ½ inch in diameter and have a maximum height of approximately 0.03 inch. Due to the "snap" action that is required with the deformable dimples, the maximum height of the dimples must be limited. The height limit is directly related to the diameter of the dimples. In cases where travel of the dimples past the sheet defining the dimples of greater than 0.03 inch is required to produce switching, the diameter of the dimples must be increased. However, in conventional typewriter keyboards where such dimples can be used for switching the center-to-center spacing of the keys is ¾ inch. Thus, the diameter of the dimples cannot be increased much beyond ½ inch where the switchplate is to be used as a component of a keyboard.

A snap action switch having relatively long tongue members is described in U.S. Pat. No. 3,800,104. The tongue members have free ends and fixed ends amounting to a design complexity undesirable in a simple keyboard application. Also, the construction of the tongue members does not provide close center-to-center switch spacing. Accordingly, there is a need for snap type switching members of relatively simple design which have a large effective diameter but may be located with a close center-to-center spacing.

OBJECTS OF THE PRESENT INVENTION

It is an object of the present invention to provide an improved switching device.

It is a further object of the present invention to provide an improved movable switching element.

It is a still further object of the present invention to provide a switching device that provides an increased travel path for switching.

It is a still further object of the present invention to provide an improved snap-type switching device.

It is a still further object of the present invention to provide a method of producing an improved switching device.

It is a still further object of the present invention to provide an improved method of making a snap-type switching device.

SUMMARY OF THE PRESENT INVENTION

In accordance with the invention, the foregoing objects are achieved by providing a plurality of arch-shaped snap-type switching members formed from a continuous metal sheet. Adjacent of the switching elements extend in different directions, preferably, transverse directions. The directional orientation of the switching elements permits the effective diameter of the switching elements to be made large while still allowing a close center-to-center spacing of the switching elements.

The switching devices are formed in the metal sheet by forming a first plurality of groups of parallel slots in a first direction and a second plurality of groups of parallel slots in a direction substantially transverse to the first direction. One of the slots of the first plurality of groups is made longer than the other slots such that that slot defines two switching elements, thereby providing a close center-to-center spacing of the switching elements which are formed by plastically deforming the area between adjacent slots in a die having a male member with convex arched sections. The switching elements of the invention are particularly well suited for use in a keyboard since they can be located with a close center-to-center spacing and still provide a large travel distance for effecting switching.

The foregoing and other objects of the present invention will be readily apparent when the following specification is read in conjunction with the accompanying drawings in which:

DESCRIPTION OF THE PREFERRED EMBODIMENT

Figure 1:
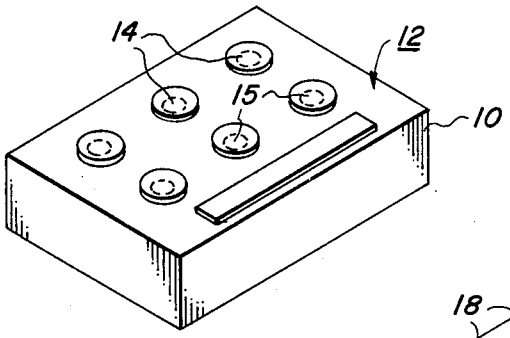
FIG. 1 is a perspective view of a switching device incorporating the present invention.

Referring now to FIG. 1, a data entry device 10 having a keyboard 12 is schematically illustrated. The keyboard 12 includes a plurality of keys 14 arranged in a predetermined manner for depression by the fingertips of an operator. Preferably, the keys 14 have a center-to-center spacing of ¾ inch. Each key has a post 15, shown in phantom, that would contact or be disposed adjacent the movable switching elements or members to be described.

Figure 2:
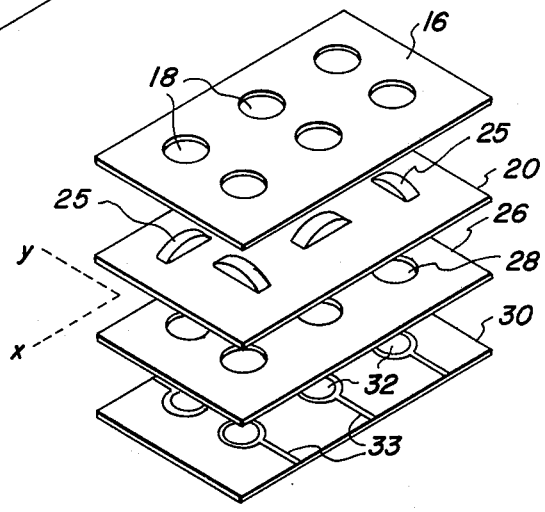
FIG. 2 is an exploded view of a keyboard utilizing the switching members of the present invention.

Referring now to FIG. 2, the keyboard 12 of FIG. 1 is shown in greater detail and in an exploded form. The keyboard includes an insulating cover plate 16 having a plurality of openings 18 therein. A metal switchplate 20 is mounted immediately below, and preferably in contact with, cover plate 16. The switchplate 20 is a continuous metal sheet, for example, a 0.001-inch thick sheet of beryllium copper, having a plurality of resiliently deformable switching members 25 formed therefrom. The switching members 25 are convex upward, in the form of "round" arches, and have both ends as integral parts of the switchplate 20. Some of the switching members 25 have their long dimension in a first direction, i.e., parallel to the X-axis, and other of the switching members 26 have their long dimension in a direction transverse to the first direction, i.e., parallel to the Y-axis. Preferably, as shown, adjacent switching members 25 of any row of switching elements have their long dimensions in transverse directions. Each of the members 25 is in register with a hole 18.

Immediately below the switchplate 20 is an insulating spacer 26 which may be of any conventional insulating material, such as Mylar. Spacer 26 has a plurality of holes 28 therein, with each hole positioned in registration with a different one of the switching members 25. Holes 28 and openings 18 can be circular, as shown, or of any other convenient shape, such as rectangular, and can be rectangles which have their long axis oriented in different directions as do the switching elements 25. Positioned below the insulating spacer 26 and in contact therewith is a circuit board 30, of any conventional insulating material, which has a plurality of metal contacts 32 on the upper surface thereof, with electrical conductors 33 leading to each contact 32. The contacts 32 are positioned in registration with the holes 28, the switching members 25, and the apertures 18. The plate 16, the switchplate 20, the spacer 26, and the circuit board 30, form a "sandwich" which is extremely compact and occupies only a top, thin layer of the device 10.

Figure 3:
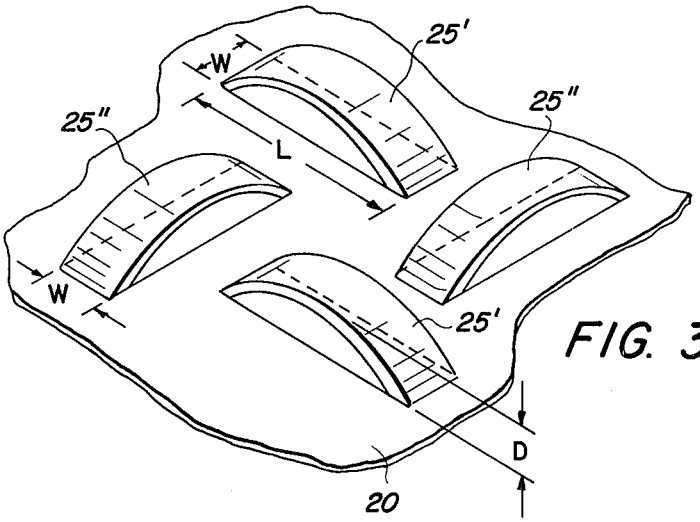
FIG. 3 is an isometric view of a group of the switching members of the device of FIG. 2.

A perspective view of several adjacent switching members is shown in exploded form in FIG. 3. As shown, the switching members are preferably in the form of round arches which are convex upward. By "round" it is meant that they have the shape of a segment of circles. However, that shape is not critical and the arches can have an elliptic, hyperbolic or other appropriate curved geometric shape. The long axis L of each of the arches 25' extends in a direction which is transversed to the direction of the long axis L of the arches 25''. As shown, the arches 25 are integral with the remainder of the metal switchplate 20, that is, formed from a continuous material.

As previously mentioned, the distance that a snap type switching member can travel in the Z-axis is directly related to the diameter of the member and the diameter is limited by the center-to-center spacing of the keys which actuate the switching member. Due to the novel arch shape and layout of switching members 25, the effective diameter of the switching members 25 can be made larger than the diameter of the switching elements taught by U.S. Pat. No. 3,643,041, while still allowing a close center-to-center spacing of the switching members 25. For example, with plate 20 being a 0.005-inch thick sheet of beryllium copper, and with the arches having the shape of a segment of a circle, with a cord length L of 1 inch, a width W of ¼ inch, and a maximum displacement D in the Z axis of 0.10 inch, a center-to-center spacing of the switching members 25 of ¾ inch can be achieved. The dimensions L, W, and D of the arches are only exemplary and their dimensions can be varied depending upon what force is desired to snap the switching element from its convex shape to a concave shape, what displacement of the switching element is desired when it snaps, and what center-to-center spacing is desired.

Figure 4:
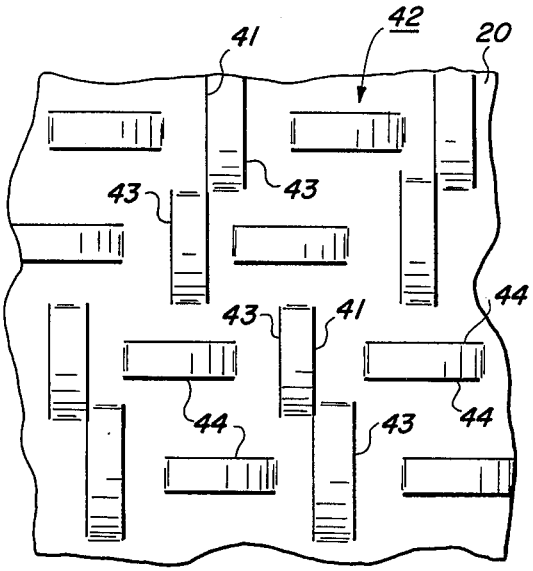
FIG. 4 depicts the switching members of the present invention during one step in the manufacture thereof.
Figure 5:
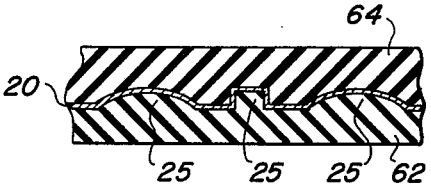
FIG. 5 depicts the switching members of the present invention during another step in the manufacture thereof.

A method of making the arched switching members 25 is illustrated in FIGS. 4 and 5, which show only a portion of the plate 20 during the manufacturing process. As shown in FIG. 4, first a first plurality of groups 40 of parallel slots which extend in a first direction and a second plurality of groups 42 of parallel slots which extend in a direction transverse to the first direction are formed in plate 20. Each of the first plurality of groups 40 consists of three slots with the central slot 41 being longer than the outer slots 43. The outer slots 43 are of substantially equal length with one having a first end adjacent one end of the longer slot 41, and the other having a first end adjacent the opposite end of the longer slot 41. The outer slots 43 have their other ends terminate on opposite sides of the midpoint of the central slot 41, that is, the slots 43 are longer than ½ the length of the central slot 41. Each of the second plurality of groups 42 consists of two slots 44 of equal length. For example, to provide arches having a center-to-center spacing of ¾ inch, a dimension L and W of 1 inch and ¼ inch, respectively, the central slots of the first groups 40 would be 1½ inches long with all of the other slots of both groups being 1 inch long with spacings of ⅛ inch between adjacent slots oriented in transverse directions. Obviously, dimensions are only exemplary, and dimensional variations may be made to get desired spacings without departing from the spirit of the invention.

The slots of groups 40 and 42 can be formed by conventional printed circuit techniques, such as, for example, by chemical etching. In such an etching process a protective film of a light setting resist is applied to the top surface of, for example, a chromate-gelatin, and then light of a frequency which will set the film is projected onto plate 20 through a photographic negative of the desired slot pattern. Next, the portions of the plate 20 over which the resist has not set, which would conform to the desired slot pattern are etched away, for example, by cupric chloride, to produce the desired slot pattern, after which the hardened film is removed.

Next, as shown in FIG. 5, the slotted metal sheet 20 is placed in a die, the male member 62 contacting the bottom surface of plate 20, and the female member 64 contacting the top surface of plate 20. The male die member 62 has protruding therefrom convex arched sections conforming to the desired shape, direction and spacing (orientation) of the switching members 25, and the female die member 64 has concave sections slightly larger than the protrusion of the male die member 64 but conforming to their shape, direction and spacing. For example, the arches of member 62 can have the shape of a segment of a circle, and have a length, width and height conforming to the dimensions of the exemplary switching members 25. After the sheet 20 is placed in the die with the convex and concave arches of the male and female members, respectively, centered over and between appropriate pairs of parallel slots in metal sheet 20, the die members are brought together to plastically deform sections of the metal sheet 20 such that arch sections, such as those shown as switching members 25 in FIG. 2, are formed. The deformation of the sections of the sheet 20 is such that the normal position of the arches is upward or convex; however, the material of sheet 20 is of such thickness that the arches can be forced or snapped to a concave position, returning automatically to the convex position when the force is removed.

Figure 2A:
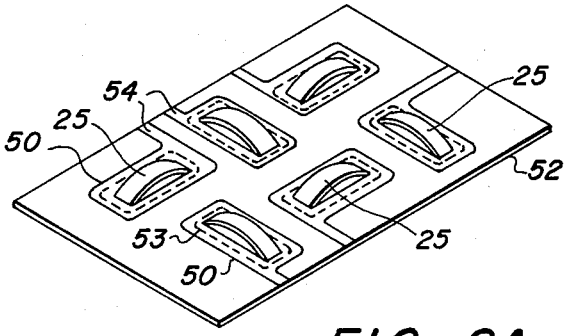
FIG. 2*a* is an exploded view of another form of keyboard utilizing the switching members of the present invention.
Figure 6:
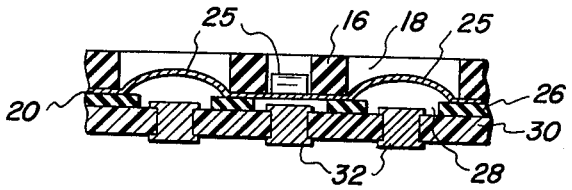
FIG. 6 is a cross-sectional view showing the switching members of the present invention.

A cross-sectional view of several of the switching members 25 of FIG. 2 is shown in FIG. 6. It may be seen that the arches 25 are convex upward and extend into the holes 18. An electrical circuit (not shown) may be connected between the switching members 25 and the contact buttons 32. The circuit selected to be energized, of course, would depend on which of the buttons 32 comes in contact with its corrsponding arched switching member 25. As shown in FIG. 2*a*, the arched switching members 25 can be formed on thin metallized areas 50 of a circuit board 52 which also has a hole 53 beneath each of the members 25 such that members 25 can travel to achieve a switching action. A potential can be applied to each switching member 25 via a lead 54 which forms part of areas 50.

Figure 7:
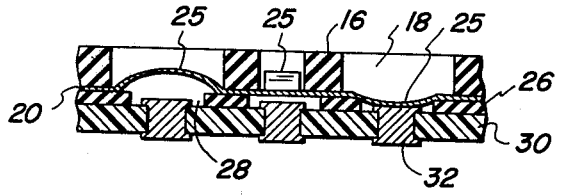
FIG. 7 is a cross-sectional view of the switching members of FIG. 6, with one shown in a closed-circuit condition.

The operation of the keyboard of the present invention may be described by reference to FIGS. 6 and 7, wherein it may be seen in FIG. 6 that no electrical contact exists between any of the arched switching members 25 and the buttons 32. To achieve switching an operator's fingertip or other force exerting means is placed in one of the openings 18 of the plate 16, such as the right opening, such that it contacts the convex surface of the arched switching members 25 therebetween. Obviously, insulation may be provided to prevent electrical shock to the operator. Downward pressure on the contacted arched switching member 25 will be resisted until a certain predetermined force is exerted, whereupon the arch "collapses" with a snap action, resulting in the convex portion of the arch becoming concave and the arch contacting the contact button 32 therebeneath, as shown in FIG. 7. This snap action results in a mechanical sensory feedback signal through the fingertip of the operator. The action of the arch while collapsing is a modified overcentering action wherein a force on the convex portion of the arch beyond a predetermined portion results in the collapse of the arch but does not cause the arch to permanently assume a convex shape; rather, immediately upon releasing the arch, it will snap into its original shape. This snap action provides the operator with a desired mechanical sensory feedback signal which enables the operator to determine that the key has properly been depressed.

Figure 8:
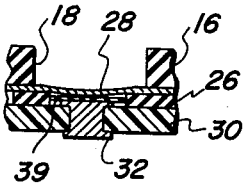
FIG. 8 is a cross-sectional view illustrating another embodiment of a switching member of the present invention.

The keyboard described above incorporates switches which make or break electrical contact between switching members 25 and corresponding contact buttons 32. A cross-sectional view of another embodiment of the present invention is shown in FIG. 8 which is similar to the device of FIG. 2 but includes in addition a thin insulator 39 over contacts 32. When one of the switching members 25 is depressed to a concave position, as shown in FIG. 8, the capacitance between the contact button 32 and the depressed switching member 25 is substantially greater than when the member 25 was in its original convex position. Therefore, a circuit connected between the contact button 32 and the depressed member 25 will have a variable capacitance depending upon the position of the member 25. Conventional capacitance changes sensing circuitry may be utilized to detect this change in capacitance resulting from the depression of the arch 25, thus providing a switch operable through an induced change in capacitance.

It may therefore be seen that a large contact displacement in the Z axis may be achieved with close contact spacing. Also, the force required to snap the arch can easily be controlled by varying the width of the arch and different arches on the same keyboard can be made to snap with different applied forces by making these arches with different widths or curvatures. Also, the novel switching element provides an improved mechanical sensory feedback signal through the fingertips of the operator while also providing maximum key travel and close key spacing.

What I claim is:

1. A switch assembly comprising, in combination:

a first member supporting a first plurality of stationary electrical contacts, a second member supporting a second plurality of electrical contacts, each of said second plurality of electrical contacts having a forcibly movable arch-shaped portion supported at both ends thereof, the arch-shaped portion of some of said second plurality of electrical contacts extending in a first direction and the arch-shaped portion of other of said second plurality of electrical contacts extending in a second direction, first means for maintaining the arch-shaped portion of each of said second plurality of electrical contacts in axial alignment with a different one of said stationary electrical contacts with said arch-shaped portion of each of said second plurality of electrical contacts being oriented such that it is arched away from its associated stationary electrical contact, and second means for applying a force to the archshaped portion of a selected one of said second plurality of electrical contacts to change the shape of the arch-shaped portion of said selected one of said second plurality of electrical contacts such that it is forced into assuming a shape arched toward its associated stationary electrical contact to thereby effect a switching action, the arch-shaped portion of said selected one of said second plurality of electrical contact assuming its original shape when said force is no longer applied thereto.

2. The switch assembly of claim 1 wherein said first means maintains said first and second members in close proximity such that said arch-shaped portion of said selected one of said second plurality of electrical contacts contacts its associated stationary contact when it assumes a shape arched toward its associated stationary contact to thereby effect a contact switching action.

3. The switch assembly of claim 1 further including electrically insulating means disposed between said first plurality of electrical contacts of said first member and said second plurality of electrical contacts of said second member and wherein said first means maintains said first and second members in close proximity such that said arch-shaped portion of said selected one of said second plurality of electrical contacts contacts said insulating means when it assumes a shape arched toward its associated stationary contact to thereby effect a capacitive switching action.

4. The switch assembly of claim 1 wherein said second member is a continuous metallic sheet having the arch-shaped portions of said second plurality of electrical contacts as an integral part thereof.

5. The switch assembly of claim 1 wherein said second member is a continuous sheet of an electrically insulating material having a plurality of apertures therein with a metalized surface extending over each of said apertures, each of said metalized surfaces providing one of said second plurality of electrical contacts with said arch-shaped portion of each of said second plurality of electrical contacts positioned over one of said apertures of said sheet of electrically insulating material.

6. The switch assembly of claim 1 wherein said first direction is transverse to said second direction.

7. The switch assembly of claim 1 wherein said second plurality of electrical contacts are aligned in rows with the arch-shaped portions of adjacent electrical contacts of a row extending in transverse directions.

8. A keyboard assembly for effecting an electrical change upon depression of a selected switch actuating member comprising:

a first member supporting a first plurality of stationary electrical contacts, a second member supporting a second plurality of electrical contacts, each of said second plurality of electrical contacts having a forcibly movable arch-shaped portion terminated on each side by an end portion, said end portions of each of said second plurality of electrical contacts being continuous with a supporting surface and said arch-shaped portion of each of said second plurality of electrical contacts being disjoined from said supporting surface continuous with its related end portions, said arch-shaped portion of each of said second plurality of electrical contacts having a length between its related end portions which is greater than the width of said arch-shaped portion with said length of each of said arch-shaped portions defining the direction of each of said second plurality of electrical contacts, some of said second plurality of electrical contacts extending in a first direction and other of said second plurality of electrical contacts extending in a second direction different from said first direction, a plurality of switch actuating means, and first means for maintaining said second member intermediate said first member and said plurality of switch actuating means, with the arch-shaped portion of each of said second plurality of electrical contacts in axial alignment with a different one of said switch actuating means and with a different one of said stationary electrical contacts with said archshaped portion of each of said second plurality of electrical contacts being convex toward its aligned switch actuating means, said first means also normally electrically insulating said contacts of said first member from said contacts of said second member, forcible movement of a selected one of said switch actuating means changing the curvature of the arch-shaped portion of its associated one of said second plurality of electrical contacts from convex toward the aligned switch actuating means to concave toward the aligned switch actuating means to thereby effect a switching action.

9. The switch assembly of claim 8 wherein said second member is a continuous metallic sheet having the arch-shaped portions of said second plurality of electrical contacts as an integral part thereof.

10. The switch assembly of claim 8 wherein said second member is a continuous sheet of an electrically insulating material having a plurality of apertures wherein with a metalized surface extending over each of said apertures, each of said metalized surfaces providing one of said second plurality of electrical contacts with said arch-shaped portion of each of said second plurality of electrical contacts positioned over one of said apertures of said sheet of electrically insulating material.

11. The switch assembly of claim 8 wherein said first direction is transverse to said second direction.

12. The switch assembly of claim 8 wherein said second plurality of electrical contacts are aligned in rows with the arch-shaped portions of adjacent electrical contacts of a row extending in transverse directions.

13. A keyboard assembly for effecting an electrical change upon depression of a selected switch actuating member comprising:

a first member supporting a first plurality of stationary electrical contacts, a second member supporting a second plurality of electrical contacts, each of said second plurality of electrical contacts having a forcibly movable arch-shaped portion terminated on each side by an end portion, said end portions of each of said second plurality of electrical contacts being continuous with a supporting surface and said arch-shaped portion of each of said second plurality of electrical contacts being disjoined from said supporting surface continuous with its related end portions, a plurality of switch actuating means, and first means for maintaining said second member intermediate said first member and said plurality of switch actuating means, with the arch-shaped portion of each of said second plurality of electrical contacts in axial alignment with a different one of said switch actuating means and with a different one of said stationary electrical contacts with said archshaped portion of each of said second plurality of electrical contacts being convex toward its aligned switch actuating means, said first means also normally electrically insulating said contacts of said first member from said contacts of said second member, forcible movement of a selected one of said switch actuating means changing the curvature of the arch-shaped portion of its associated one of said second plurality of electrical contacts from convex toward the aligned switch actuating means to concave toward the aligned switch actuating means to thereby effect a switching action.

* * * * *